United States Patent [19]

Crowther

[11] 4,187,567

[45] Feb. 12, 1980

[54] WATERBED

[76] Inventor: Curt P. Crowther, 663 S. 13th East, Salt Lake City, Utah 84112

[21] Appl. No.: 930,921

[22] Filed: Aug. 4, 1978

[51] Int. Cl.[2] ..... A47C 27/08

[52] U.S. Cl. ..... 5/451; 5/499

[58] Field of Search ..... 5/365, 367, 368, 370, 5/371, 349, 350, 369, 366, 334 R, 448–458

[56] References Cited

U.S. PATENT DOCUMENTS

| | | | |
|---|---|---|---|
| 4,062,077 | 12/1977 | Autrey et al. | 5/365 |
| 4,100,635 | 7/1978 | Mitchell et al. | 5/371 |
| 4,145,781 | 3/1979 | Autrey et al. | 5/370 |

*Primary Examiner*—Alexander Grosz
*Attorney, Agent, or Firm*—Richard F. Bojanowski

[57] ABSTRACT

A waterbed construction having an inner rigid frame member and a supported flexible bottom member for holding and laterally supporting a water filled bladder or vinyl mattress. The inner rigid frame member and bladder are covered and interlocked by a cushioned "cap" having rigid side walls and a flexible top member. The cushioned cap fits closely over the inner rigid frame member in much the same manner as a cover fits over a box. This arrangement provides additional strength for containing the lateral forces generated by the water filled bladder and at the same time provides maximum sitting comfort. In addition, the use of a close fitting cap having outer rigid side walls in combination with an inner rigid walled frame member, provides a sealed container for the bladder and virtually eliminates the possibility of water loss in the event the bladder develops a leak.

6 Claims, 3 Drawing Figures

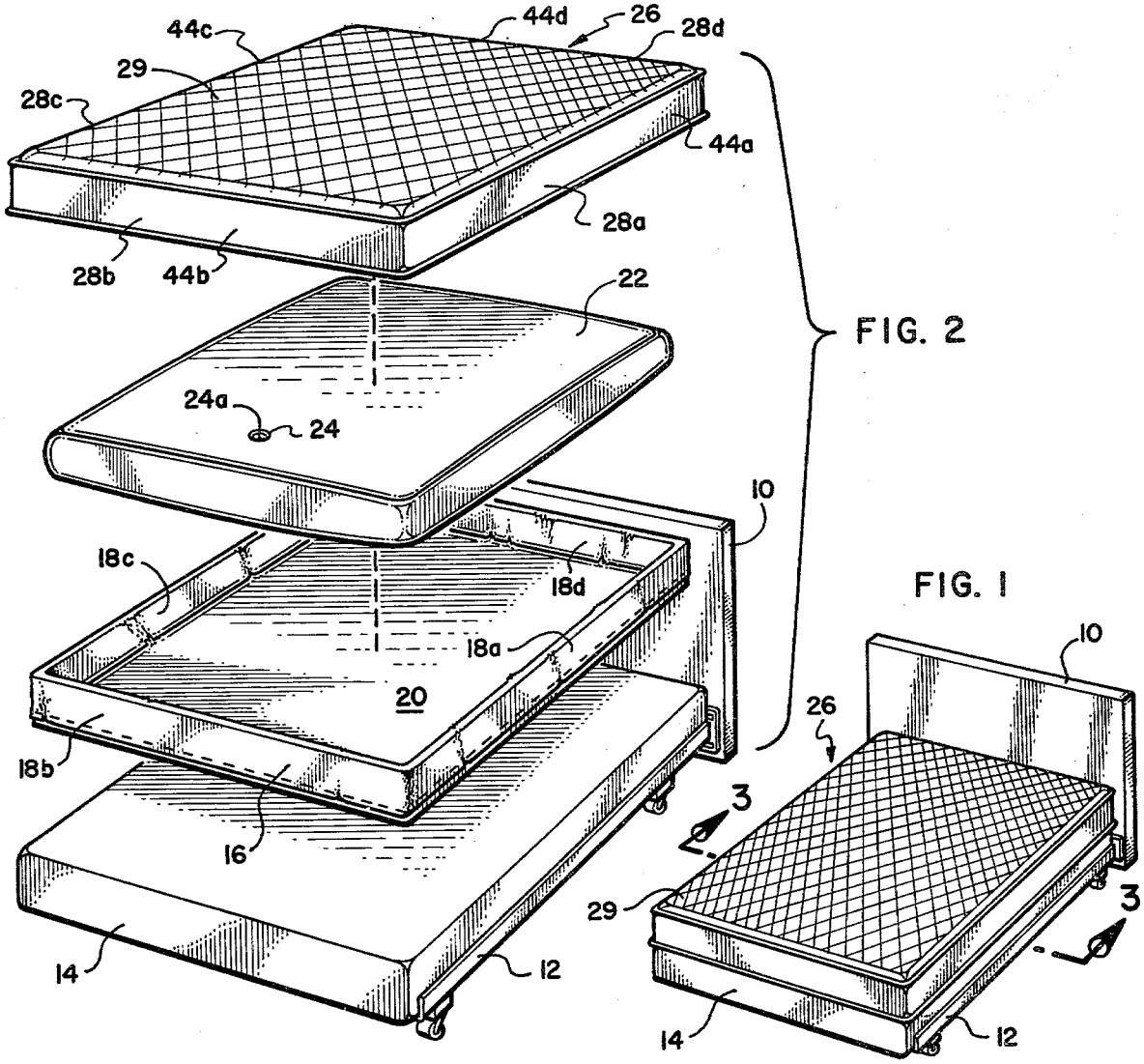
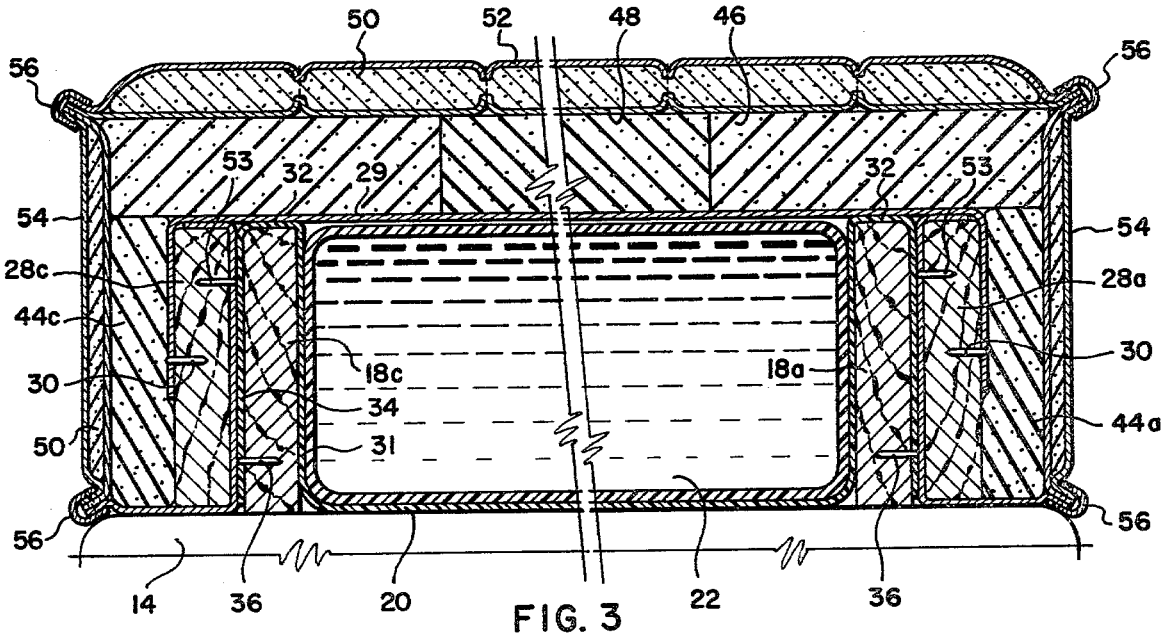
FIG. 3

WATERBED

BACKGROUND OF THE INVENTION

1. Field of the Invention

This invention is directed generally to waterbeds and particularly to waterbeds having an inner rigid frame member adapted to receive a cushioned cap or cover having rigid outer side walls.

2. State of the Art

During the past several years, there has been a substantial increase in interest and demand by the public for quality water beds. In response thereto, the waterbed industry has made important advances in making waterbeds more practical and more appealing to the public. This is evidenced by the substantial increase in issued patents in the waterbed field during the past decade. Some of the more important advances are reflected in the U.S. Pat. Nos. listed below:

3,736,604; 3,735,432; 4,015,299; & 4,062,077.

U.S. Pat. Nos. 3,736,604 and 3,735,432, for example, show generally the use of an inner frame having rigid side walls for containing the lateral forces generated by a bladder filled with water. The use of foam rubber to cover the frame is also disclosed in the above patents. In addition, U.S. Pat. No. 4,015,299 discloses the use of an inner frame for supporting a water filled bladder wherein the frame and bladder are surrounded by a dense foamy material for tempering unpleasant resonant wave characteristics. In U.S. Pat. No. 4,062,077, a rigid inner frame is described whereby the frame is adapted to receive a cushioned shell for covering the frame and the bladder held therein.

Although the above patents fairly well describe the advances recently made in the waterbed art, certain disadvantages still remain. In the use of a non-rigid cushioned shell, for example, there is a tendency for the cushioned side walls to separate near or at the bottom of the frame when a person is sitting or lying on the waterbed. In addition, this separation can cause migration of the insulating materials covering the bladder. Although this can be remedied by fastening a flexible cover (which normally encompasses the inner rigid frame member and the insulating material) to the frame's rigid side walls, this results in a cap or cover which for all practical purposes is permanently fixed to the inner rigid frame member and cannot be conveniently removed.

As previously stated, the lateral forces generated by a water filled bladder are held in check by the inner frame's rigid side walls. In order to prevent the side walls from breaking or bowing, relatively sturdy and costly materials must be used in constructing the frame's side walls. In addition, the end fastening means used in the construction of the frame must be selected with care to insure against separation and weakening of the frame's side walls.

One of the major disadvantages of most all waterbeds is, that in the event of a bladder leak, water can be released over the safety liner (inner rigid frame member) and onto the floor or be absorbed into the foam padding circumscribing and covering the bladder. If water is permitted to escape, floor and carpet damage may occur and the waterbed cannot be comfortably utilized until the water saturated foam rubber padding is completely dried.

OBJECTS OF THE INVENTION

In order to avoid the above disadvantages, it is the primary object of this invention to provide a waterbed with a cover having outer rigid side walls which overrides the bladder and supporting inner frame. Another object of this invention is to provide a waterbed which contains a substantially sealed or enclosed bladder caused by interlocking an outer rigid side walled cover with an inner rigid frame member. Another object of this invention is to provide a waterbed which minimizes, if not eliminates, migration of the bladder's insulating cover. Finally, it is an object of this invention to provide a waterbed which has the appearance and decor of a conventional bed yet possesses all of the advantages of a waterbed.

Additional objects, advantages and features of this invention will be readily apparent from the description and accompanying drawings hereinafter referred to in describing a preferred embodiment of this invention.

SUMMARY OF THE INVENTION

The above objects of this invention are attained by a waterbed construction comprising an inner rigid frame member for holding and laterally supporting a liquid filled bladder and a removable cushioned cover unit or "cap" having outer rigid side walls and a flexible top member securely fastened thereto.

More specifically, the above waterbed construction includes a water filled bladder, an inner framework for circumscribing the bladder and providing lateral support thereof and an overlying cushioned cover or cap, having outer rigid side walls and a flexible top cover.

The cushioned cover or cap includes a resilient or foam rubber material for covering and circumscribing the top cover and outer surfaces of the cover's outer rigid side walls. To provide maximum comfort, an additional outer cover is provided for encompassing the cushion and is of such length that its ends can be fastened to the inner surface of the cover's outer rigid side walls. With the above construction, the cushioned cap can be removed as a complete unit and thereby facilitate access to the bladder.

BRIEF DESCRIPTION OF THE DRAWINGS

FIG. 1 is a perspective view showing one embodiment of the assembled waterbed of this invention;

FIG. 2 is an exploded perspective view showing the main components which comprise the waterbed shown in FIG. 1;

FIG. 3 is an enlarged cross-sectional view taken along line 3—3 of FIG. 1.

DETAILED DESCRIPTION OF A PREFERRED EMBODIMENT

The waterbed construction of this invention as shown in FIG. 1 and FIG. 2 includes a conventional backboard 10, vertically fixed to one end of a conventional wheeled metal frame 12. A platform base 14 which for purposes of this embodiment, is queen sized, is supported on the wheeled metal frame 12. Positioned on top of the platform base is an inner rectangularly shaped framework 16, having four rigid side walls **18*a*, 18*b*, 18*c*, and 18*d* respectively, and a water impervious flexible bottom wall 20. The flexible bottom wall 20 is normally a vinyl sheet having a thickness of about 20 mils. The vinyl sheet has extended end portions which follow the contours of the inner surface of the inner rigid side walls and over its top edge. The extended end portions are then securely fastened to the outer surface of the inner side walls 18***a*, 18*b*, 18*c*, and 18*d* to, in effect, provide a vinyl lined container for the bladder 22. This feature is more clearly shown in FIG. 3, and will be subsequently described in more detail.

The bladder 22 shown in the drawings is designed to accomodate a queen sized bed and will normally hold about 56 gallons (317 liters) of water weighing about 637.5 pounds (286.8 kilograms). A king size bed will of course require a larger bladder while a standard sized twin bed would require a substantially smaller bladder. The bladder shown has a length of about 75 inches (190.5 centimeters) and a width of about 55 inches (139.7 centimeters). However, these dimensions, as well as the dimensions of the inner framework, can be varied depending on the size and shape of the bed. The bladder will normally have a height or thickness of about 5 inches (12.7 centimeters) which is fairly much standard for all bed sizes.

The bladder is preferably constructed from a high density polymeric material, such as polyvinyl chloride, having a thickness of from about 20 mils to 26 mils. The polymeric material is treated with an antifungicide which prevents the growth of fungi within the water filled bladder. The bladder is adapted with an opening 24 and plug 24*a* for introducing and removing water from the bladder.

Bladders suitable for use in this invention are avaible from a number of commercial suppliers such as American National Watermattress Corp. located in Orange, California.

The cover or cap unit referred to generally be numeral 26 includes four outer rigid side walls 28*a*, 28*b*, 28*c*, and 28*d* respectively. The outer side walls are joined by means of screws, nails, glue, glue staples or other fastening means at its end to form a rectangularly shaped box to which is fastened a flexible top cover 29. To further support the outer rigid side walls or the inner rigid side walls, a Nylon or plastic strip may be fastened over the outer corners of the side walls. The flexible top cover has extended end sections so that they can be draped over and fastened to the outer surfaces of the four rigid side walls by nails or stapling 30. The top cover 29 is made from a material used in formulating the flexible bottom wall 20 of the inner rigid framework 16. Preferably this material is a polymer derived from polyvinyl cloride, having a thickness of about 20 mils.

Referring now to FIG. 3, which more clearly shows the inter-relationship of the elements above described.

The bladder 22 is contained within an inner rigid framework 16, having four rigid side walls 18*a*, 18*b*, 18*c*, and 18*d*, fastened together by fastening means, such as nails, glue, screws, glue staples, and the like. The water impervious bottom wall 20 of the above framework 16 consists of a flexible vinyl sheet, cut and/or folded such that its extended end sections will follow the contours of the inner wall 31, of the inner rigid side walls 18*a*, 18*b*, 18*c*, and 18*d* of the framework. The end sections are wrapped over the top edge 32 of the inner side wall 18 and along the contours of the outer surface 34 of the inner rigid side walls 18, and fastened thereto by tacks, nails, or staples 36. This construction provides a water tight bottom container for the bladder 22 and will retain some of the water from overflowing in the event the bladder is damaged and a leak develops.

The inner framework 16 is constructed from wood or any material having a rigidity equivalent to wood. Its dimensions can be varied over a broad range to accomodate most any sized bladder. However, for a queen sized bed, the inner rigid framework 16 will have a length of between about 75 inches (190.5 centimeters), a width of about 55 inches (139.7 centimeters) and a height of about 5.0 inches (12.7 centimeters).

The thickness of the wood will also vary, depending on the type of wood used. Preferably, it should have a small degree of flexibility so that the outer surface of the inner side walls 18*a*, 18*b*, 18*c*, and 18*d* will exert a slight force against the inner surface of the outer side walls 28*a*, 28*b*, 28*c*, and 28*d* of the cap or cover 26. This force is generated by the lateral forces exerted by the water filled bladder 22. These forces, in combination with the vinyl material of the overlapping top cover which is sandwiched therebetween, forms an interlocking means or seal which insures against water leakage. This sealing characteristic minimizes the possibility of water damage to flooring and to the surrounding foam rubber cushions in the event of bladder leakage.

The cap or cover as previously described includes four rigid side walls 28*a*, 28*b*, 28*c*, and 28*d*, joined at their ends to form a rectangularly shaped box. A flexible water impervious top cover 29 over-rides the four rigid outer side walls. The total surface area of the top cover is greater than the top surface area of the box to provide an overhang which can be securely fastened to the outside surface of each of the cover's outer side walls 28*a*, 28*b*, 28*c*, and 28*d*. In addition to the outer rigid side walls 28*a*, 28*b*, 28*c*, and 28*d*, and the flexible cover 29, the cap includes four side cushions 44*a*, 44*b*, 44*c*, and 44*d*, a top cushion 46 and an intermediate flexible cover 48. Preferably the top cover is constructed from a "ticking" material to provide sufficient slidable movement with the vinyl bottom cover of the inner rigid framework and thereby facilitate removal of the cap or cover. Although a vinyl or plastic material may be used, a non-plastic material such as cotton or a cotton blend material is preferred. The side cushions generally possess the dimensions of the rigid side walls and will be approximately 1.25 inches (2.75 centimeters) in thickness. The side cushions are preferably constructed from polyurethane type material available commercially under various trade names. Such materials will normally have the following physical properties and/or characteristics:

Density-pcf: 1.05–1.95
Indent load (lbs.) 4" thick at 25% deflection: 12–45
Indent Load Ratio (65/25): 1.5–2.2
Tensile-psi: 6.0–17.0
Elongation %: 130–190
Tear Resistance lb./inch: 1.3–2.5

The top cushion is generally from two to four times as thick as the side cushions and will preferably be constructed from materials such as a one pound polyurethane foam having ILD numbers of about 10–12 or the like. If desired the top cushion may be divided into a plurality of sections and may be cut from different grades of polyurethane foam to provide the degree of firmness and comfort desired.

A second layer of thinner padding 50 is placed over the intermediate cover and along the side cushions and held in position by a quilted top cover 52 and side cover 54 made of a fabric to resemble a conventional inner spring mattress. Preferably the top cover 52 is quilted to the intermediate cover 48. The second top and side covers are sewn along their edges, or otherwise fastened to provide a tape edge or bead 56, similar to that found on a conventional mattress. The edge of the second side cover 54 is folded under the outer rigid side walls 28*a*, 28*b*, 28*c*, and 28*d* of the cap or cover 26 and securely fastened to their inner faces by nails or staples 53. After fastening, the cap or cover 26 is a single unit which can be readily removed from the inner rigid framework 16 which holds the bladder 22.

In use, the cover, which includes the outer rigid side walls 28*a*, 28*b*, 28*c*, and 28*d* and the surrounding cushions which are held in place by a quilted top cover can be readily removed to expose the bladder which is contained within the inner rigid frame member 16. Due to the lateral forces generated by the water in the bladder against the inner rigid side walls, a corresponding interlocking or sealing effect is produced between the inner and outer rigid side walls. This interlocking or sealing effect is more evident when the overlap from either the top cover 52 or the flexible bottom wall 20 is sandwiched between the inner and outer side walls and an additional force is generated such as that generated when the water bed is occupied.

Although certain preferred embodiments have been illustrated and described hereinabove, it should be understood that various changes may be made without departing from the spirit and scope of the disclosed inventive concept, which is limited only by the claims appended hereto.

I claim:

1. A waterbed comprising an inner rigid frame member having a rigidity and flexibility equivalent to wood for circumscribing and laterally supporting a liquid containing bladder and removable cushioned cover unit having outer rigid side walls having a rigidity and flexibility equivalent to wood and flexible top member for covering said bladder a flexible bottom wall member which follows the contours of the inner surface of the inner rigid frame member and is fastened to the outer surface of said rigid frame member, wherein the rigidity and flexibility of said inner and outer rigid side walls are such that the outer surface of said inner side walls will exert a slight force against the inner surface of said outer side walls and flexible member to provide an interlocking and sealing effect when in use.

2. The waterbed of claim 1 wherein said removable cushioned cover unit is covered by an outer cover having an overhang which is fastened to the inner walled surface of said outer rigid side walls.

3. The waterbed of claim 1 wherein said outer cover is quilted.

4. A waterbed comprising a bladder for holding a liquid, an inner rigid frame member having a rigidity and flexibility equivalent to wood circumscribing said bladder and providing lateral support therefore when said bladder is filled with said liquid, a shell overlying said inner rigid frame member said shell comprising an outer framework having rigid side walls having a rigidity and flexibility equivalent to wood and dimensions such that it can circumscribe said inner rigid frame member, yet allows for easy removal, a top sheet extending over the opening of the outer framework to provide a cover for such shell, a cushion covering said outer side walls and said top sheet, and an outer cover overriding said cushion and fixed to the inner walls of said outer framework, so that said shell can be removed as a single unit a flexible bottom wall member which follows the contours of the inner surface of the inner rigid frame member and is fastened to the outer surface of said rigid frame member, wherein the rigidity and flexibility of said inner and outer rigid side walls are such that the outer surface of said inner side walls will exert a slight force against the inner surface of said outer side walls and flexible member to provide an interlocking and sealing effect when in use.

5. The waterbed of claim 4 wherein said flexible bottom wall is water impervious.

6. The waterbed of claim 5 wherein said top sheet is water impervious.

* * * * *